United States Patent [19]

Ribaudo

[11] Patent Number: 4,987,638

[45] Date of Patent: Jan. 29, 1991

[54] SLIDING DOOR ASSEMBLY

[76] Inventor: Nickolas Ribaudo, 3970 N.W. 27th Ter., Boca Raton, Fla. 33434

[21] Appl. No.: 190,481

[22] Filed: May 5, 1988

[51] Int. Cl.[5] ..... E05D 15/00

[52] U.S. Cl. ..... 16/89; 16/94 R; 16/95 R; 16/96 R; 16/106; 16/107; 160/196.1; 49/409; 104/93

[58] Field of Search ..... 16/87.4 R, 89, 87 R, 16/95 R, 95 D, 95 DW, 102, 106, 107, 27, 45, 87 B, 90, 91, 94 R, 96 R, 97, 98, 99, 105; 160/196.1, 199, 201; 152/323; 295/31.1, 32, 34; 49/409–412; 104/93, 110, 125

[56] References Cited

U.S. PATENT DOCUMENTS

| | | | |
|---|---|---|---|
| 807,141 | 12/1905 | Tatum | 16/106 |
| 1,073,509 | 9/1913 | Nelson | 16/106 |
| 1,560,524 | 11/1925 | Avery | 16/107 |
| 2,212,998 | 8/1940 | Crane . | |
| 2,485,296 | 10/1949 | Lescaze | 49/411 |
| 2,736,055 | 2/1956 | Bell | 16/95 D |
| 3,072,169 | 1/1963 | Hashings, Jr. | 16/107 |
| 3,074,356 | 1/1963 | Parker et al. | 16/95 R |
| 3,451,095 | 6/1969 | Kiefer . | |
| 3,935,822 | 2/1976 | Kaufmann | 104/93 |
| 4,073,034 | 2/1978 | Martens | 16/87 R |
| 4,120,072 | 10/1978 | Hormann | 160/201 |
| 4,357,733 | 11/1982 | Neville | 16/107 |
| 4,433,627 | 2/1984 | Forshee | 16/107 |

FOREIGN PATENT DOCUMENTS

| | | | |
|---|---|---|---|
| 1158925 | 12/1983 | Canada . | |
| 465390 | 9/1928 | Fed. Rep. of Germany . | |
| 964030 | 5/1957 | Fed. Rep. of Germany | 16/95 R |
| 3201874 | 8/1983 | Fed. Rep. of Germany . | |
| 2064515 | 7/1971 | France . | |
| 2185226 | 12/1973 | France . | |
| 2376230 | 7/1978 | France . | |
| 985868 | 3/1965 | United Kingdom | 104/93 |

*Primary Examiner*—Kurt Rowan
*Assistant Examiner*—Edward A. Brown
*Attorney, Agent, or Firm*—Kenyon & Kenyon

[57] ABSTRACT

A sliding door assembly comprising a door hanger, a hanger sheave, an upthrust roller and a track, wherein the hanger sheave assembly and the uptrust roller are rotatably mounted on the door hanger. The track provides a first rolling surface for the hanger sheave and a second rolling surface for the upthrust roller. The track also preferably captures the upthrust roller thereby preventing the assembly from leaving the track.

13 Claims, 1 Drawing Sheet

SLIDING DOOR ASSEMBLY

The present invention is directed to a novel sliding door assembly, and particularly to a sliding door assembly useful with elevators.

BACKGROUND

Various assemblies for providing (vertical) support while permitting (lateral) movement of doors are known in the art. Such assemblies have been utilized for elevator cab and hoistway door panels, doors on railway freight cars, as well as other types of slidable doors. The present invention is useful in many types of slidable doors, but will be described herein with reference to elevator doors for which it is particularly useful Conventional sliding door assemblies typically comprise a door track, a door hanger, a hanger sheave and an upthrust roller. The door hanger is a support which is typically fastened to the upper portion of a door panel, and which supports and allows the sliding movement, e.g. horizontally, of the door panel. The hanger sheave typically comprises a wheel or roller that is connected to a door panel by the door hanger. The door track is a rail which accepts the rolling assembly of door hanger and allows the horizontal sliding movement required to open and close the doors. An upthrust roller is a roller bearing installed onto an eccentric shaft and mounted on the door hanger for limiting the (vertical) motion of a (horizontally) sliding door panel to keep the panel from lifting off the door track.

One such type of conventional elevator door assembly known in the art is shown in FIG. 1 wherein an elevator cab or hoistway door panel 10 (hereinafter the door panel) is slidably supported on door track 50 via door hanger 20. A hanger sheave (roller) assembly 30 is rotatably mounted on door hanger 20. Hanger sheave assembly 30 is designed to receive projecting portions 51 of door track 50. Though not shown in FIG. 1, door track 50 is securely mounted such that it can support door panel 10. To prevent the hanger sheave assembly 30 from jumping off door track 50 when the elevator door 10 is jolted by mechanical means or by people moving equipment onto or out of the elevator, the conventional design incorporated an upthrust roller 40 mounted on door hanger 20. The upthrust roller 40 is conventionally placed slightly below and in close proximity to, for example, 0.020–0.030 inches, door track 50. Thus, in normal operation, hanger sheave assembly 30 rolls along door track 50 and projections 51 and upthrust roller 40 only contacts projections 51 if the elevator door 10 is jolted. Upthrust roller 40 is conventionally eccentrically mounted on door hanger 20 via adjustable mount 45 in a manner which permits the adjustment of the gap between upthrust roller 40 and door track 50.

The traditional assembly containing a track, hanger, hanger sheave and upthrust roller has provided fairly good service through the years. However, one inherent problem still exists. This problem is caused by the wearing of the hanger sheave 31 and its effect upon the critical relationship between the upthrust roller 40 and track 50. For example, as the hanger sheave 31 wears, a gradual but substantial clearance will develop between the underside of the door track 50 and the upthrust roller 40. If a periodic re-adjustment is not performed to the upthrust roller 40, the hanger sheave assembly 30 may easily jump off of the track 50. This often occurs when the door panels 10 are struck by mechanical means or by person moving equipment on or out of the elevators.

Another disadvantage of the conventional design shown in FIG. 1 is that since hanger sheaves are typically formed of synthetic materials such as nylon or another plastic material which may readily melt in the event of a fire, the door panel 10 could easily become stuck thereby trapping the occupants in the elevator.

Another known design for a door hanger is shown in U.S. Pat. No. 807,141, to J.J. Tatum, patented Dec. 12, 1905. That design incorporates two rollers, C C, which are positioned about a rail 1. That patent does not disclose the desirability of adjusting the bottom roller and lacks the advantages of the present invention described below.

Another known assembly is disclosed in U.S. Pat. No. 1,024,502, to P.M. Elliott, patented Apr. 30, 1912, which discloses a door mechanism for a railway freight car and antifriction roller F which rests upon the upper face of a track flange $b^2$ and a small roller F′ positioned below the track flange.

Another sliding door assembly is shown in Patentschrift, No. 964,030, dated May 16, 1957. From the figures of this Patentschrift, it is apparent that this design utilizes rollers within a rail but does not disclose the use of upthrust rollers. With reference to FIG. 4, it will be appreciated that the two rollers 123 and 223 each support different elements 113 and 213, respectively.

Still another known arrangement is disclosed in U.S. Pat. 4,120,072, to M. Hormann, patented Oct. 17, 1978, for a COMBINED SUPPORTING ROLLER-FRICTION DRIVE ARRANGEMENT FOR OVERHEAD SINGLE-PANEL DOORS. This design is somewhat similar to that described above with reference to prior art FIG. 1 wherein a roller 6 rides on a running track 8, however in this design, counterpressure rollers 12 contact the underside 13 of running track 8. Counterpressure rollers 12 are provided with an adjusting means 16 permitting the adjustment of the counterpressure rollers 12 in the direction toward the running track 8. In accordance with this design, at least one of the counterpressure rollers 12 is always in contact with the bottom side 13 of the running track 8. (see column 3, lines 49–55)

It will be appreciated that the known sliding door assemblies which utilize an upthrust roller in close proximity to the track require continual maintenance to ensure that the gap between the upthrust roller and door track does not become so great that the hanger sheave can be jolted off the track. The other designs which place the track assembly in continuous contact with an upthrust roller result in the wearing down of not only the hanger sheave but also the upthrust roller and, if the upthrust roller is formed of a metal such as steel, may cause an irritating noise during use.

SUMMARY

The present invention overcomes the disadvantages of the previously known assemblies with a sliding door assembly comprising a door hanger, a hanger sheave assembly, an upthrust roller and a track, wherein the hanger sheave assembly and the upthrust roller are rotatably mounted on the door hanger. In accordance with the present invention the track provides a first rolling surface for the hanger sheave and a second rolling surface for the upthrust roller. The track also preferably captures the upthrust roller thereby preventing the assembly from leaving the track.

DETAILED DESCRIPTION

The present invention comprises a novel track and sliding door assembly which is useful for suspending and guiding sliding doors such as the sliding door panels of an elevator cab or hoistway doors.

Figure 1:
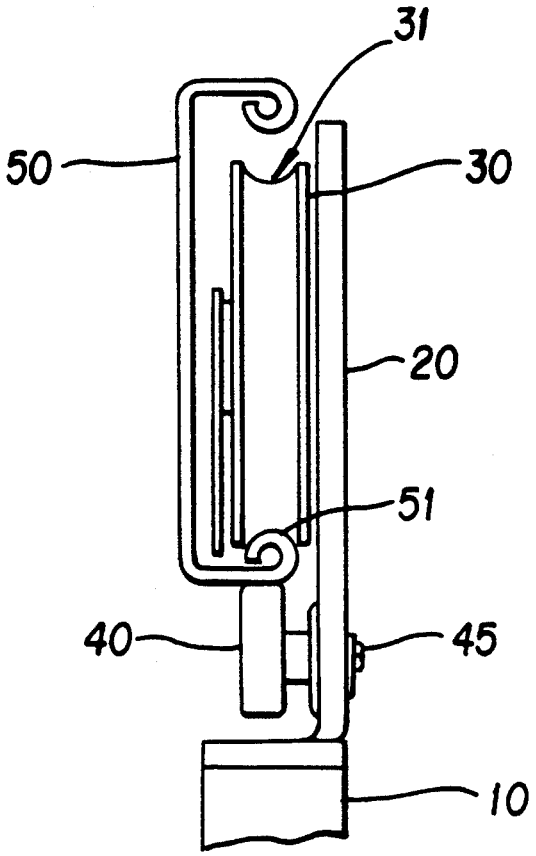
FIG. 1 PRIOR ART
FIG. 1 is a cross-sectional view of a conventional sliding door assembly of the prior art.
Figure 2:
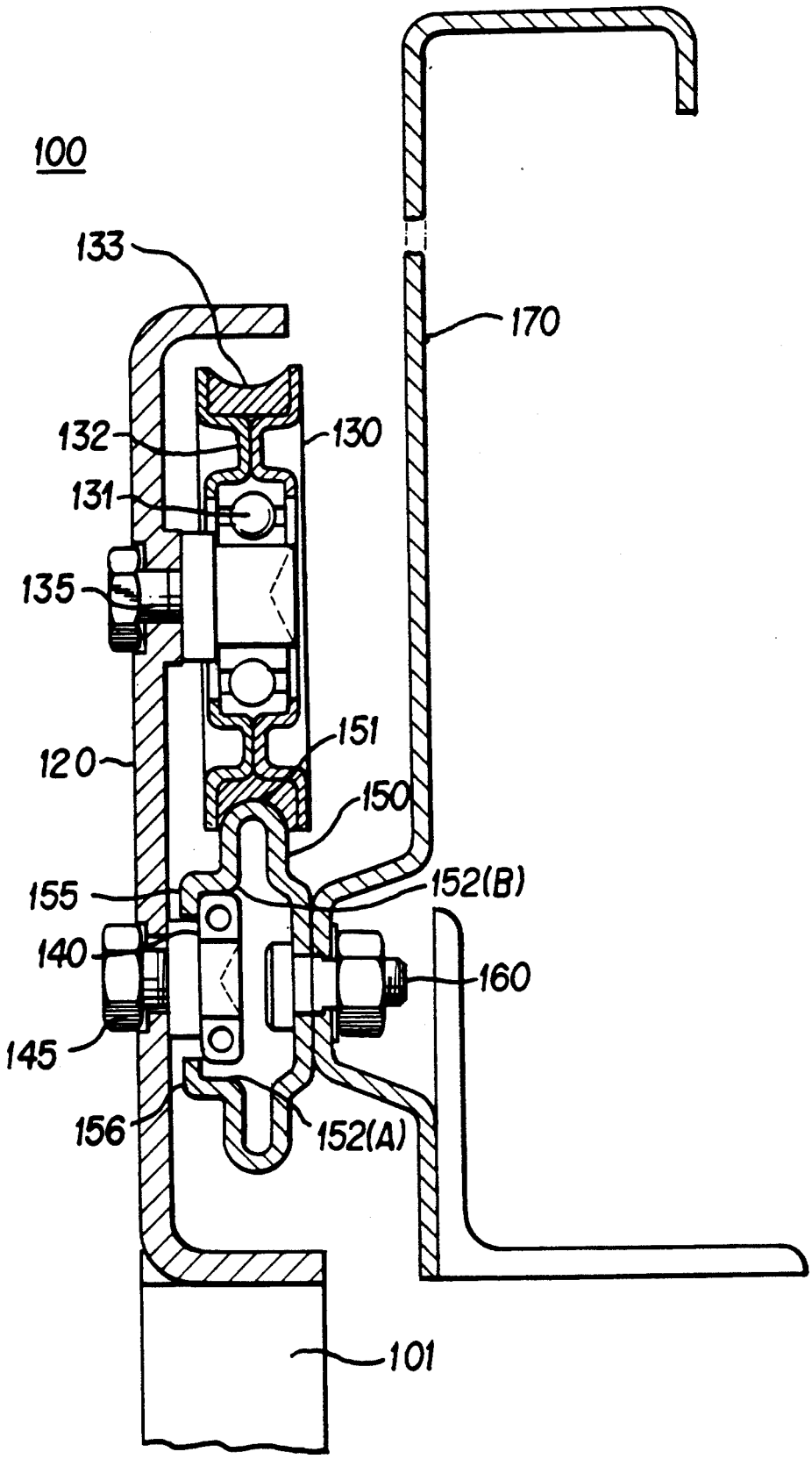
FIG. 2 is a cross-sectional view of the sliding door assembly of the present invention.

With reference to FIG. 2, the present invention comprises sliding door assembly 100 comprising a track 150, a door hanger 120 supporting a moveable door panel 101. A hanger sheave assembly 130 is rotatably mounted on door hanger 120. The hanger sheave assembly 130 comprises a bearing 131, a sheave 132 and may also advantageously comprise an insert 133. The sheave assembly 130 is rotatably mounted on hanger 120 with axle 135. In operation, the sheave assembly 130 slidably supports the hanger 120 and thereby the door panel 101 on track 150. It will be appreciated by those skilled in the art that the insert 133 may be advantageously formed of a non-metallic material, such as rubber or polyurethane in order to reduce the amount of noise created when the sheave 132 rolls along track 150.

The present invention also comprises an upthrust roller 140 which is also rotatably mounted on hanger 120, via upthrust roller shaft 145.

Track 150 is securely mounted in a manner in which it can provide support to hanger 120 and door panel 101, for example, via a bolt 160 which secures track 150 to, for example, a header 170. Track 150 is configured and mounted such that it provides an exterior, upper rolling surface 151 upon which sheave assembly 130 rolls during normal operation, and also comprises interior, upthrust rolling surfaces 152A and 152B upon which upthrust roller 140 can roll and be supported when captured in track 150. Track 150 also preferably comprises outer lips 155 and 156 which "capture" upthrust roller 140 and thereby prevent the hanger 120 and attached door panel 101 from becoming dislodged from track 150.

By the term "capture" it is meant that the track 150 surrounds enough of the upthrust roller 140 to prevent the upthrust roller from exiting the interior portion of track 150. With reference to FIG. 2, it will be appreciated that lips 155 and 156 sufficiently enclose the upthrust roller 140 to prevent the lateral exiting of the upthrust roller 140 from the interior portion of the track 150.

In accordance with the present invention, when the sliding door assembly 100 is in normal operation, sheave assembly 130 provides rolling support for hanger 120 and door panel 101, and rolls along the exterior, upper surface 151 of track 150. As the sheave assembly insert 133 wears, the hanger 120 will move downwardly relative to track 150 also causing the lowering of upthrust roller 140 within track 150. This downward relative movement is stopped when roller 140 contacts interior, lower rolling surface 152(A) of track 150.

While the upthrust roller 140 may be formed of any suitable load bearing material, it is preferable that the upthrust roller be made of steel. Thus, in the unfortunate event of a fire, the insert 133, which as stated above can be formed of a synthetic material such as nylon or another plastic, may melt and therefore no longer support hanger 120. In such circumstances, the sliding door assembly 100 of the present invention continues to provide rolling support for door panel 101 via upthrust roller 140 and interior, lower rolling surface 152(A) of track 150. In this case, the upthrust roller 140 formed of suitable metal e.g. steel, will still allow the free movement of the door panel 101, albeit noisy. As stated above, upthrust roller 140 also contacts interior roller surface 152 under less traumatic circumstances as when the sheave simply wears down. Under these circumstances, the noisy operation of the sliding door panel 101 provides an indication to maintenance personnel that the sheave should be replaced.

Thus it will be appreciated that the novel track design of the present invention provides at least two major advantages with respect to conventional tracks previously employed in sliding door assemblies. First, by the preferred "capturing" of the upthrust roller, the sheave assembly 130 and hanger 120 are prevented from being knocked off the track 150. Secondly, if the insert material 133 which serves somewhat as a tire on the hanger sheave 132 becomes completely worn away, the interior, lower roller surface 152 of the track supports the upthrust roller 140 and thereby serves as a means by which the door panel 101 may continue to move along the track 150. This feature advantageously reduces the risk of passengers being trapped inside elevator cabs due to faulty or damaged sliding door assemblies.

The novel track configuration 150 illustrated in FIG. 2 provides the further advantage of being reversible. It will be appreciated by those skilled in the art, that track 150 can simply be rotated such that the bottom portion of the track 150 as shown in FIG. 2 becomes the top. It will also be appreciated that track 150 can serve both as a left hand track and a right hand track due to its symmetrical configuration as shown in FIG. 2. While such a reversible track configuration 150 as shown in FIG. 2 is preferred, this reversibility is not necessary for the practice of the present invention.

I claim:

1. A sliding door assembly comprising a door hanger, an upthrust roller rotatably mounted on said door hanger, and a track for a sliding door assembly, said track comprising means adapted to receive a supporting member, an exterior, upper portion adapted to provide a rolling surface for a sheave, and an interior, lower portion spaced from said exterior, upper portion adapted to provide a rolling surface for an upthrust roller so that in the event of the failure of the sheave, the upthrust roller can move into contact with the interior, lower portion of the track, thereby allowing the door to continue operating;

wherein said track has a symmetrical, reversible configuration and further comprises a bottom portion positioned opposite from said exterior, upper portion; said bottom portion being rotatable about a horizontal axis such that said bottom portion of said track becomes said exterior, upper portion which provides said rolling surface for said sheave, while said exterior, upper portion become said bottom portion; and said track also being able to serve as a left-hand track and a right-hand track.

2. A track according to claim 1, wherein said track further comprises means to prevent the lateral exiting of the upthrust roller from the interior of said tack.

3. A track according to claim 2, wherein the preventing means comprises two lips positioned in substantially the same plane.

4. A sliding door assembly comprising a door hanger, a hanger sheave, an upthrust roller and a track, wherein said hanger sheave and said upper upthrust roller are rotatably mounted on said door hanger; and wherein said track provides a first exterior, rolling surface for said hanger sheave and a second interior rolling surface for said upthrust roller and wherein said track further comprises capture structure along its length for preventing the upthrust roller from becoming dislodged from the track.

5. A sliding door assembly according to claim 4, wherein the hanger sheave comprises an insert.

6. A sliding door assembly according to claim 4, wherein said upthrust roller is formed of metal.

7. A sliding door assembly according to claim 5, wherein said insert comprises rubber.

8. A sliding door assembly according to claim 5, wherein said insert comprises polyurethane.

9. A sliding door assembly according to claim 6, wherein said metal comprises steel.

10. A sliding door assembly according to claim 4, wherein said second interior surface is oriented below said upthrust roller.

11. A sliding door assembly according to claim 4, wherein the capture structure prevents both the upper and the lower portions of the upthrust roller from becoming dislodged from the track.

12. A sliding door assembly comprising a door hanger, a hanger sheave, an upthrust roller and a track, wherein said hanger sheave assembly and said upthrust roller are rotatably mounted on said door hanger;

wherein said track comprises upper and lower portions in spaced apart relation defining an interior space therebetween, the upper of which provides a first exterior, rolling surface for said hanger sheave assembly and a second interior rolling surface for said upthrust roller, and the lower of which provides a third interior rolling surface for said upthrust roller so that in the event of the mechanical failure or wear of the hanger sheave, the third surface would continue to provide a rolling surface upon which the upthrust roller could roll and thereby continue to provide support for a door.

13. A sliding door assembly comprising a door hanger, a hanger sheave, an upthrust roller and a track, wherein said hanger sheave assembly and said upthrust roller are rotatably mounted on said door hanger;

wherein said track comprises upper and lower portions in spaced apart relation defining an interior space therebetween, the upper of which provides an exterior rolling surface for said hanger sheave assembly, and the lower of which provides an interior rolling surface for said upthrust roller so that in the event of the mechanical failure or wear of the hanger sheave, the interior surface would provide a rolling surface upon which the upthrust roller could move into contact with and thereby continue to provide support for a door.

* * * * *